US006951289B2

(12) United States Patent
Scott, Jr.

(10) Patent No.: US 6,951,289 B2
(45) Date of Patent: Oct. 4, 2005

(54) SAFETY SUPPORT FOR A LONG BARRELED WEAPON

(75) Inventor: Robert B. Scott, Jr., Taylor, AR (US)

(73) Assignee: GWN Grabber Products, Inc., Camden, AR (US)

( * ) Notice: Subject to any disclaimer, the term of this patent is extended or adjusted under 35 U.S.C. 154(b) by 67 days.

(21) Appl. No.: 10/766,567

(22) Filed: Jan. 29, 2004

(65) Prior Publication Data

US 2005/0167378 A1 Aug. 4, 2005

(51) Int. Cl.[7] ..... A47F 7/00
(52) U.S. Cl. ..... 211/64
(58) Field of Search ..... 211/64, 65, 66, 211/89.01, 68, 62, 67

(56) References Cited

U.S. PATENT DOCUMENTS 3,917,071 A * 11/1975 Walters ..... 211/64
5,344,032 A * 9/1994 Ramsdell ..... 211/64
5,454,931 A * 10/1995 Lauve, Jr. ..... 206/317
5,560,497 A * 10/1996 Mulvihill, Jr. ..... 211/4

* cited by examiner

*Primary Examiner*—Peter M. Cuomo
*Assistant Examiner*—Sarah Purol
(74) *Attorney, Agent, or Firm*—Dennis B. Haase

(57) ABSTRACT

A safety grip for securing a long barreled weapon during transportation or when not in use, comprising a mounting bracket for securely mounting the grip to a stable surface. A nesting pad is supported by the bracket over a recess in the bracket. The nesting pad has an opening therein and a slit extending access to the opening in order that the barrel of the weapon to be secured may be slipped into the opening with the butt of the weapon supported on a surface below the grip. Finally, a raised portion in the nature of a ring is formed about the opening in the nest pad to add additional strength and stability to the pad and, thereby, enhance the effectiveness of the grip.

10 Claims, 2 Drawing Sheets

SAFETY SUPPORT FOR A LONG BARRELED WEAPON

The present invention relates generally to gun safety devices, and, more particularly, for a safety device for supporting a long barreled weapon, such as a rifle or shotgun, at the ready, during transportation or in a stationary environment.

BACKGROUND OF THE INVENTION

1. Field of the Invention

In many states, hunting is, or is becoming, a major sport. Whereas food was the original objective in the beginning, in more modern times a trophy has become a preoccupation. Contests are run and, in some instances, considerable prize money is at stake.

As the deer woods becomes more crowded, and the duck blinds are in constant demand, gun safety has become a major concern. Programs directed toward gun safety are legion, and trigger locks and the like are readily available in various shapes and sizes. Such devices are relatively useless, however, unless they are used.

While the market for hunters is proliferated with gun rests and sighting devices, there is a paucity of devices which would permit a hunter to transport and store his rifle or shotgun is a safe manner, while not inhibiting his or her immediate access to that weapon should an opportunity arise.

It is to this circumstance to which the present invention is focused.

2. Overview of the Prior Art

Perhaps the most closely allied art found relative to accomplishment of the objectives of the present invention is Vilotti U.S. Pat. No. 3,746,177. Vilotti contemplated a magnet for holding fishing rods and guns in an upright position in a saddle leaning against a motor vehicle.

The Vilotti device has several rather obvious deficiencies as they relate to gun safety, the first of which is where do you put the Vilotti device when there is no ferro-magnetic surface on which to mount it. Vilotti solves that issue by using a backing strip. However, does a hunter want to have the device stuck to his vehicle, or even his boat? In 1973, lack of a magnetic surface was possibly not much of a problem, but in this day and age, when many boats and ATVs are primarily fibre glass or aluminum, it is a definite drawback.

Vilotti has other deficiencies such as the fact that the saddle, or slot, 19 is open. That enhances the prospect that the gun or the like being magnetically held, could be knocked out of the slot inadvertently, with potentially disastrous consequences.

Further, permanent magnets are easily damaged by striking a hard surface and, with a lessened magnetic pull, the more likely it becomes that the weapon could be inadvertently dislodged, or fall from its roost.

Wernimont, in his U.S. Pat. No. 3,361,265, has a slightly different approach for the protection and display of a gun. By mounting the gun in an essentially horizontal orientation on an adjustable saddle, it would not be as prone to falling as it would if it were vertically oriented, but it is fraught with safety concerns that would not make the device acceptable to the sport today.

As suggested above, there are several gun rests and sighting devices, which are little more than pillows, e.g., Walker III U.S. Pat. No. 5,332,185, and, perhaps, to a lesser extent, but with the same general objective, Pilgrim et. al U.S. Pat. No. 5,050,330. Finally, Zekas U.S. Pat. No. 6,158,159 provides a sighting device having some manual adjustability.

SUMMARY OF THE INVENTION

With gun safety a consistent and long standing hot button issue, the present invention attempts to address the problem in at least one phase of the hunting adventure, i.e., the transportation and/or storage of a long barreled weapon such as a rifle or shotgun.

It is accordingly, and very simply, a principal objective of the present invention to provide an innovative means of safely storing a weapon either during movement from one locale to another in a boat, motor vehicle or ATV, or at the ready in a deer stand, duck blind or the like.

It is an objective, related to the foregoing to secure the subject weapon in such a way that it can be retrieved by the hunter quickly with an affirmative and intentional motion, while preventing inadvertent dislodgement which could give rise to a potential for a misfire which might injure person or property.

A further objective of the present invention is to provide a retainer for a hunting weapon, or the like, which can be permanently affixed to a boat or other vehicle, and which securely maintains a weapon in its grasp in a vertical orientation, but in such a manner that it can be quickly removed by intentional action, but remains fixed in the device despite jostling or bumping or other inadvertent, negligent or unintentional contact.

It is yet another objective of the present invention to provide a hunter with a device that will accomplish the foregoing objectives in a very economical and affordable fashion.

These stated objectives, as well as several others, will become apparent to those skilled in the art upon a reading of the following Detailed Description of a Preferred Embodiment, taken in conjunction with the accompanying drawings, wherein:

DETAILED DESCRIPTION OF A PREFERRED EMBODIMENT

Figure 1:
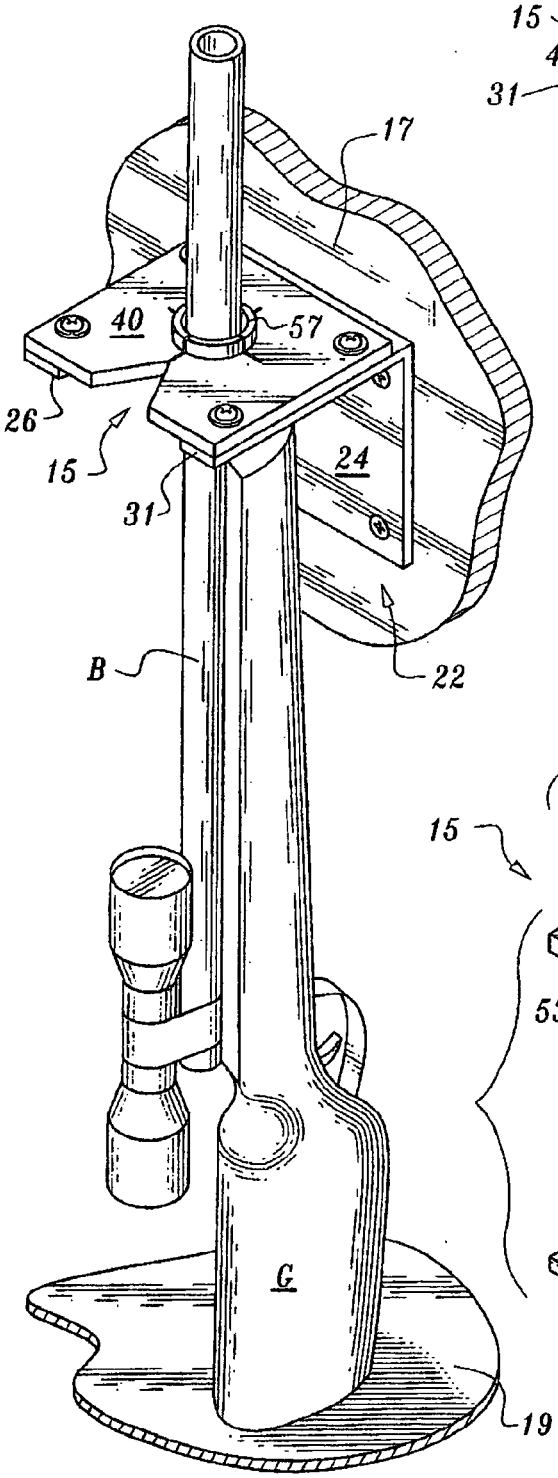
FIG. 1 is a pictorial representation of the safety device of the present invention, showing it in a typical environment in which it has particular utility.

With reference now to the drawings, and initially to FIG. 1, a mountable safety grip 15 is provided. The safety grip 15 is so constructed as to encircle and releaseably secure the barrel B of a gun G in an upright orientation, as seen in FIG. 1.

The grip 15 is illustrated as it would be used in transporting a gun G in a boat, or other transporter, having an upstanding side wall 17 and a bottom or base 19, upon which the butt of the gun normally would be expected to rest while nested in the grip 15.

Figure 2:
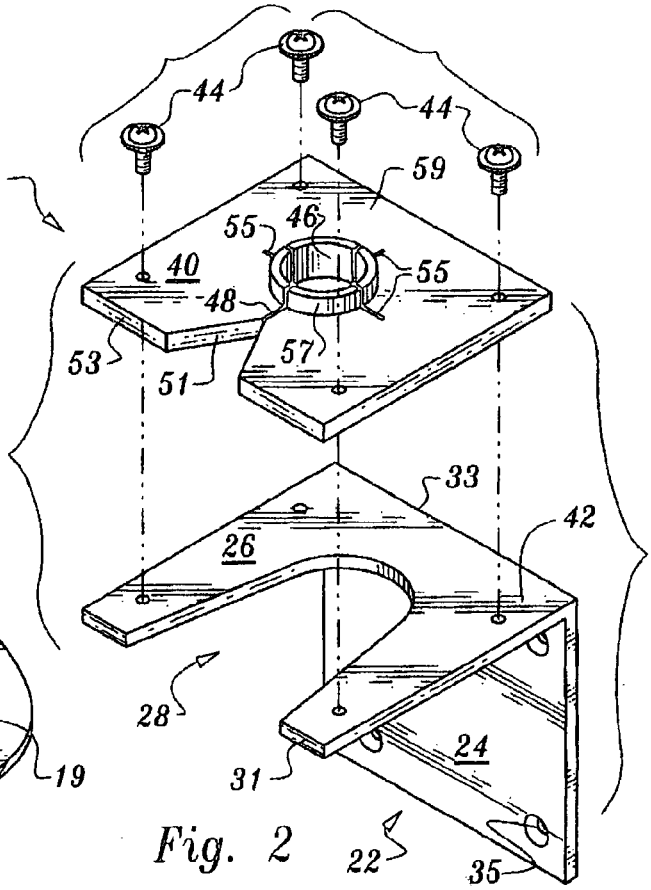
FIG. 2 is an exploded view of the safety device of the present invention illustrating the inter connection of the various elements of the device that make it especially effective in accomplishing the objectives of the invention.
Figure 4:
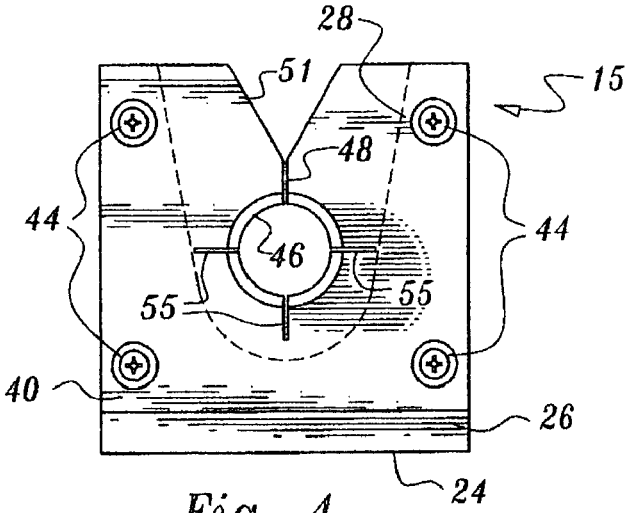
FIG. 4 is a bottom plan view of the device of FIG. 3.
Figure 5:
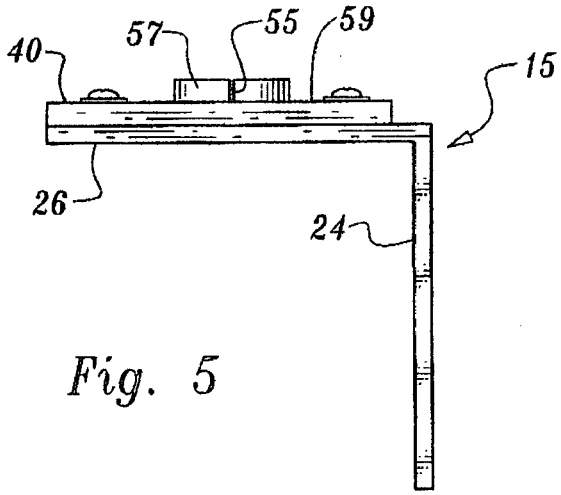
FIG. 5 is a left side elevation of the device of FIG. 3.

The safety grip 15, in keeping with the invention, comprises a mounting bracket 22, perhaps best envisioned in the exploded view of FIG. 2. The mounting bracket 22 is provided with a mounting plate 24, and a support plate 26, which, in it's the most simple form, is at right angles to the mounting plate 24. The support plate is, in its preferred state, substantially horizontal when the mounting bracket is secured to a stable surface in its intended orientation. It will be appreciated upon further reading that the precise angle between the mounting plate 24 and the support plate 26 may vary somewhat without departure from the objectives of the invention.

Figure 3:
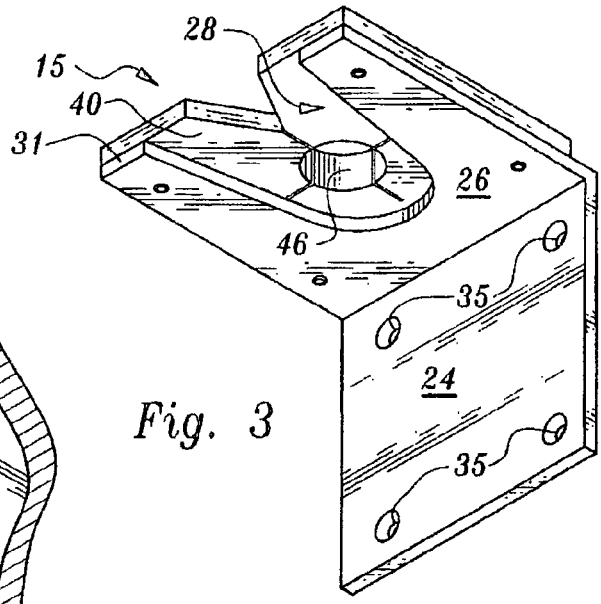
FIG. 3 is a perspective view of the device of FIG. 2, fully assembled and viewed as it would appear above and to the right of the viewer.

Returning to FIGS. 2 and 3, the support plate 24 is formed, or otherwise provided, with a substantial recess at 28, thereby forming a relatively wide opening at the free end 31 thereof, opposite the intersection 33 of the support plate and the mounting plate, and extending inwardly well past the center of the plate 24. A series of apertures 35 in the mounting plate 24 receive fasteners of an number of well known kinds readily available for attaching the mounting bracket to a stable surface.

It is the intent and purpose of the present invention to removably secure a long barreled weapon or the like in a generally upright orientation, and capable of resisting inadvertent dislodgement, while simultaneously permitting the weapon to be quickly removed from its nest in the safety grip 15 by the intentional grasping and pulling by a user. To this end, a nest pad 40 is provided. The nest pad rests on the upper surface 42 of the support bracket 24, where it is secured against movement by fasteners 44.

The nest pad is formed of a pliable material, e.g., rubber, and is formed with a circular opening 46 transverse to the plane of the support plate 24, and so aligned that the opening 46 is within the boundary of the recess 28.

In order, in keeping with the invention, that the barrel of a gun G may be inserted into the opening 46, a slit 48 is provided in the pad, and a notch 51 is formed at the end 53 thereof with the apex of the notch converging at the slit 48. Additionally, cuts 55 are formed in the nest pad 40 about the circumference of the opening 46, preferably in a symmetrical pattern, thereby providing entry into said opening, in order that barrels of various sizes can be readily accommodated without compromise to security. It will now be appreciated that a user need only press the barrel of his weapon into the notch 51 and with light pressure the barrel will pass through the slit 48 and be secured in the opening 46.

In order to further enhance the security of the grip 15, a ring 57 is formed, or otherwise provided, about the upper surface 59 of the nest pad 40 flush with the circumference of the opening, the opening defined by the ring being of substantially the same size as the opening. The ring 57 is about as high as the pad is thick, thereby adding gripping strength to the pad about the barrel of a weapon disposed therein. The cuts 55 pass through the ring in order to assure the easy insertion of the gun barrel.

The added material of the ring 57 serves another, perhaps more subtle, benefit. The pliability of the material, coupled with the added weight of the material in the ring, tend to be pulled downwardly, gravitationally, with a resultant frictional pressure added to the gun barrel, thereby enhancing the security of the nest. Indeed, the grip is sufficient on the gun barrel as to hold the weapon suspended without support at the butt.

Figure 6:
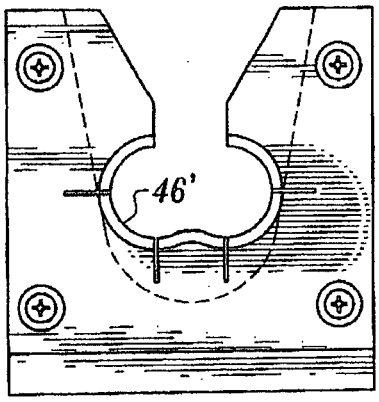
FIG. 6 is a view similar to that of FIG. 4, except the device is modified to accommodate a double barreled shot gun, graphically illustrating the versatility of the invention.

FIG. 6 provides a slight variation in the nest pad 40 without departure from the advantages of the safety grip of the present invention. More specifically, the opening 46 will be immediately recognized as so formed as to accommodate a double barreled shotgun. Specifically, the opening 46 comprises two intersecting circles, thereby presenting visually, the appearance of the two barrels of a shotgun. It will be appreciated that this particular configuration is workable for both a side by side as well as over/under barrels. Each, every and all other features ascribed to the safety grip are present with equal force and effect.

Figure 7:
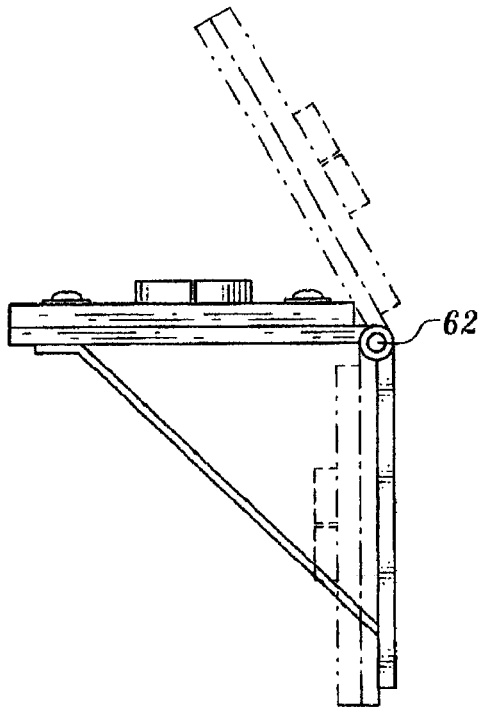
FIG. 7 is a side elevation of a modified form of the device of the present invention showing a mounting bracket which is collapsible to minimize its intrusion into space when not in use.

Yet another variation on the same theme is found in FIG. 7. In some instances, where mounting of the safety grip can not occur on a perfectly vertical surface, or where the user wishes that the grip be out of the way when not in use, or where removal of the gun G from the grip is facilitated when the support plate is at an obtuse angle, a hinge 62 is provided at the intersection of the support plate and the mounting plate. A strut 64 provides additional strength which is lost to some extent by the presence of the hinge 62. Once again, the safety and convenience features of the safety grip of the present invention are in no way compromised.

It will now be understood that the user of the gun secured in the safety grip need only grasp the weapon and pull toward him or her to quickly release the weapon for use in accordance with its intended purpose.

Having now discussed in some detail a preferred embodiment, together with some suggested alternatives, it will be appreciated by those skilled in the art that several other variations are within the contemplation of the invention and are encompassed in the claims, wherein:

1. A safety grip for engaging a long barreled weapon in a vertical attitude with barrel facing upwardly comprising a mounting bracket, said mounting bracket having a mounting plate and a support plate, said support plate having a recess therein, and said recess being open at one end thereof, said support plate being substantially horizontal when mounted as intended;

a nest pad, said nest pad being supported on said support plate, an opening in said nest pad, said opening being aligned with said recess in said support plate;

a ring disposed on said nest pad about said opening;

a slit in said nest pad, said slit running from an edge of said nest pad to said opening to thereby provide access to said opening through said slit.

2. The safety grip of claim 1, said ring being formed on said nest pad about said opening, and a slit in said ring coincident with said slit in said nest pad for receiving the barrel of a weapon to be secured in said safety grip within said ring.

3. The safety grip of claim 1, wherein said nest paid is of a pliable material, said material about said opening, and above said recess in said support plate adapted to frictionally engage the barrel of the weapon frictionally to secure the same in said safety grip.

4. The safety grip of claim 1, wherein said opening comprises a pair of intersecting circular openings.

5. The safety grip of claim 1, wherein said nest pad is provided with at least one cut intersecting said opening therein to assist in accommodating various sized gun barrels.

6. The safety grip of claim 5, wherein several cuts are provided in said nest pad about the circumference of said opening.

7. The safety grip of claim 1, wherein said nest pad is of a pliable material and said ring is also made of pliable material.

8. The safety grip of claim 1, wherein said opening comprises a pair of intersecting circular openings.

9. The safety grip of claim 2, wherein said nest pad is provided with at least one cut intersecting said opening therein to assist in accommodating various sized gun barrels.

10. The safety grip of claim 4, wherein several cuts are provided in said nest pad and said ring about the circumference of said opening.

* * * * *